US006978488B2

(12) United States Patent
Wolfson

(10) Patent No.: US 6,978,488 B2
(45) Date of Patent: Dec. 27, 2005

(54) DIVING GOGGLES WITH A COLLAPSIBLE AUXILIARY AIR SOURCE CHAMBER

(76) Inventor: Alexander Wolfson, 81 Walker Rd., Swampscott, MA (US) 01907-2050

( * ) Notice: Subject to any disclaimer, the term of this patent is extended or adjusted under 35 U.S.C. 154(b) by 214 days.

(21) Appl. No.: 10/388,305

(22) Filed: Mar. 14, 2003

(65) Prior Publication Data

US 2004/0177432 A1 Sep. 16, 2004

(51) Int. Cl.[7] ..... A61F 9/02
(52) U.S. Cl. ..... 2/452
(58) Field of Search ..... 2/428, 430, 446, 2/452; 351/43

(56) References Cited

U.S. PATENT DOCUMENTS 2,488,235 A * 11/1949 Pfeiffer ..... 2/428
4,665,570 A 5/1987 Davis
4,896,380 A * 1/1990 Kamitani ..... 2/428
5,572,989 A 11/1996 Lutz
5,642,529 A * 7/1997 Fujima ..... 2/428
5,927,281 A * 7/1999 Monteleone et al. ..... 128/858
6,195,808 B1 * 3/2001 Huang ..... 2/428
6,381,761 B2 * 5/2002 Kawashima et al. ..... 2/428
6,598,239 B1 * 7/2003 Hsieh ..... 2/428

* cited by examiner

*Primary Examiner*—Katherine M. Moran
(74) *Attorney, Agent, or Firm*—Boris Leschinsky

(57) ABSTRACT

Diving goggles with increased depth range includes a collapsible auxiliary air source chamber in fluid communication with the interior of the goggles. As the diver descends into the water depth, the outside pressure compresses the auxiliary chamber and forces some air out of that chamber and into the face chamber formed between the rigid portion of the goggles and the face of the diver. That additional compressed air when mixed with the compressed air inside the face chamber allows for relief of pressure from the user's eyes therefore avoiding eye strain and reduction in peripheral vision. The auxiliary chamber can be incorporated into the strap of the goggles and is attached to the rigid frame on both ends thereof. One or more collapsible leaf springs are placed inside the chamber to keep it open and in extended position while out of the water. Alternatively, the auxiliary chamber is made from a resilient material of such thickness as to ensure its extended shape once out of the water.

9 Claims, 3 Drawing Sheets

DIVING GOGGLES WITH A COLLAPSIBLE AUXILIARY AIR SOURCE CHAMBER

BACKGROUND OF THE INVENTION

The present invention relates generally to diving head protection equipment such as a face mask, goggles, or alike. More particularly, the invention relates to a pair of goggles equipped with an auxiliary compressible air chamber for equalizing the air pressure within the goggles to that of the surrounding water pressure and subsequently the diver body pressure in order to relieve the excessive eye pressure for the diver.

Face masks or goggles are always used by a diver to prevent water from contacting the eyes. A typical diving mask consists of a rigid oval chamber equipped with a skirt made from a flexible material such as rubber to cover and hermetically seal the upper portion of the face. Once the diver is under water, a closed chamber is formed between the skin of the diver and the inside surface of the goggles. As the diver descends, the water pressure surrounding the diver increases and pushes up against the rigid outer surface of the goggles. That pressure is partially transmitted inside the goggles as the soft skirt surrounding the rigid face portion of the goggles collapses against the face of the diver. Continuous increase of the internal goggles pressure creates unbalanced pressure on the eyes of the diver. As a result of this increased pressure, substantial eyestrain may develop as well as a reduction in peripheral vision. Therefore, there is a need for an effective means to equalize the pressure inside the goggles with that of the body pressure of the diver and relieve the eyes from that additional pressure load.

Pressure equalization in general has been attempted by many in the prior art. A typical example of a face mask with pressure equalizing means is shown in the U.S. Pat. No. 5,572,989 by Lutz. The diving mask includes a rigid frame and a lens mounted and sealed within the frame. A sealing flexible skirt is attached to the outer edge of the frame to seal the mask against the face of the diver. The skin includes a flexible nose piece that fits over the diver's nose. A stiff bracket compresses the nose through the skirt and together with an actuator causes partial or complete occlusion of the nose depending on the diving depth. The pressure is equalized via restricting the air flow through the nose of the diver. However, this design can not be applicable in case of goggles covering only the eyes of the diver.

Ear plugs have been attempted to be incorporated into a face mask or goggles to provide pressure relief for the ears. Kamitani discloses one design in the U.S. Pat. No. 4,896,380. The ear plugs are mounted on two tubes extending from the chamber between the face of the diver and the mask and transmit that pressure to the ears. That design allows the diver to hear better under water as well as to remove the plugs easily after completing the dive. Pfeiffer depicts a similar design in the U.S. Pat. No. 2,488,235, the main difference being the presence of ear cups instead of the internal ear plugs. The disadvantage of these designs is that although they provide a partial relief for the ears, no provision is made to relieve the eyes of the diver.

Compressible elements have been used in goggles and face mask designs of the prior art. Davis depicts a face mask seal in the U.S. Pat. No. 4,665,570 and similarly Huang shows a compressible seal in the U.S. Pat. No. 6,195,808. The purpose of these devices is to provide a better seal of the mask against the face or to provide a shock absorbing buffer to the user. When used under water, they will inherently allow for a certain amount of compression and therefore provide some partial protection for the diver. As the lower depths are reached however, this protection would cease and the same problem of excessive eye pressure would be present again.

The need exists therefore for goggles automatically allowing to relieve excessive eye pressure for the user while underwater at any reasonable depth of diving. The need also exists for goggles with increased depth range allowing for deeper dives.

SUMMARY OF THE INVENTION

Accordingly, it is an object of the present invention to overcome these and other drawbacks of the prior art by providing novel diving goggles capable of providing an automatic pressure relief for the eyes of the diver at any reasonable diving depth.

It is another object of the present invention to provide diving goggles equipped with an auxiliary compressible air chamber to provide for a source of compressed air to equalize the pressure inside the goggles to that of the surrounding water pressure.

It is a further object of the present invention to provide diving goggles in which the auxiliary chamber is combined with a retaining strap to attach and hold the goggles on the head of the diver.

It is a further yet object of the invention to provide the diving goggles equipped with an auxiliary air chamber having an elastic means to restore its initial shape once out of the water.

It is a further yet object of the invention to provide diving goggles with increased depth of dive without an increase of the eye pressure of the diver.

The diving goggles of the invention are equipped with an auxiliary collapsible air chamber designed into the strap of the goggles. That chamber is in fluid communication with one or more face chambers of the goggles. The cavity inside the chamber serves as an air source. It is allowing for excess air to leave the chamber and move into the face chamber between the goggles and the eyes of the diver or to accept excess air from the face chamber into the auxiliary chamber. The auxiliary chamber is made from a flexible material such as rubber. Because of that, once the diver is descending into the water depths and the pressure is rising, it is that chamber, which is first compressed by the surrounding water and not the face chamber. Air is squeezed out of the auxiliary chamber and into the face chamber and thus the eye strain of the diver is relieved. On the way up, as the outside pressure is decreasing, the elastic element within the auxiliary chamber provides for restoration of its initial shape as the excess air is moving back into that chamber from the face chamber of the goggles. As a result, an automatic pressure compensation for the eyes of the diver is achieved and most problems of eye strain and decreased peripheral vision are avoided.

BRIEF DESCRIPTION OF THE DRAWINGS

A more complete appreciation of the subject matter of the present invention and the various advantages thereof can be realized by reference to the following detailed description in which reference is made to the accompanying drawings in which:

FIG. 6 shows an enlarged crosssectional view of lower right section of the goggles as on FIG. 1, while FIGS. 2 through 4 show enlarged cross-sectional views in comparison with the scale of FIG. 1.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
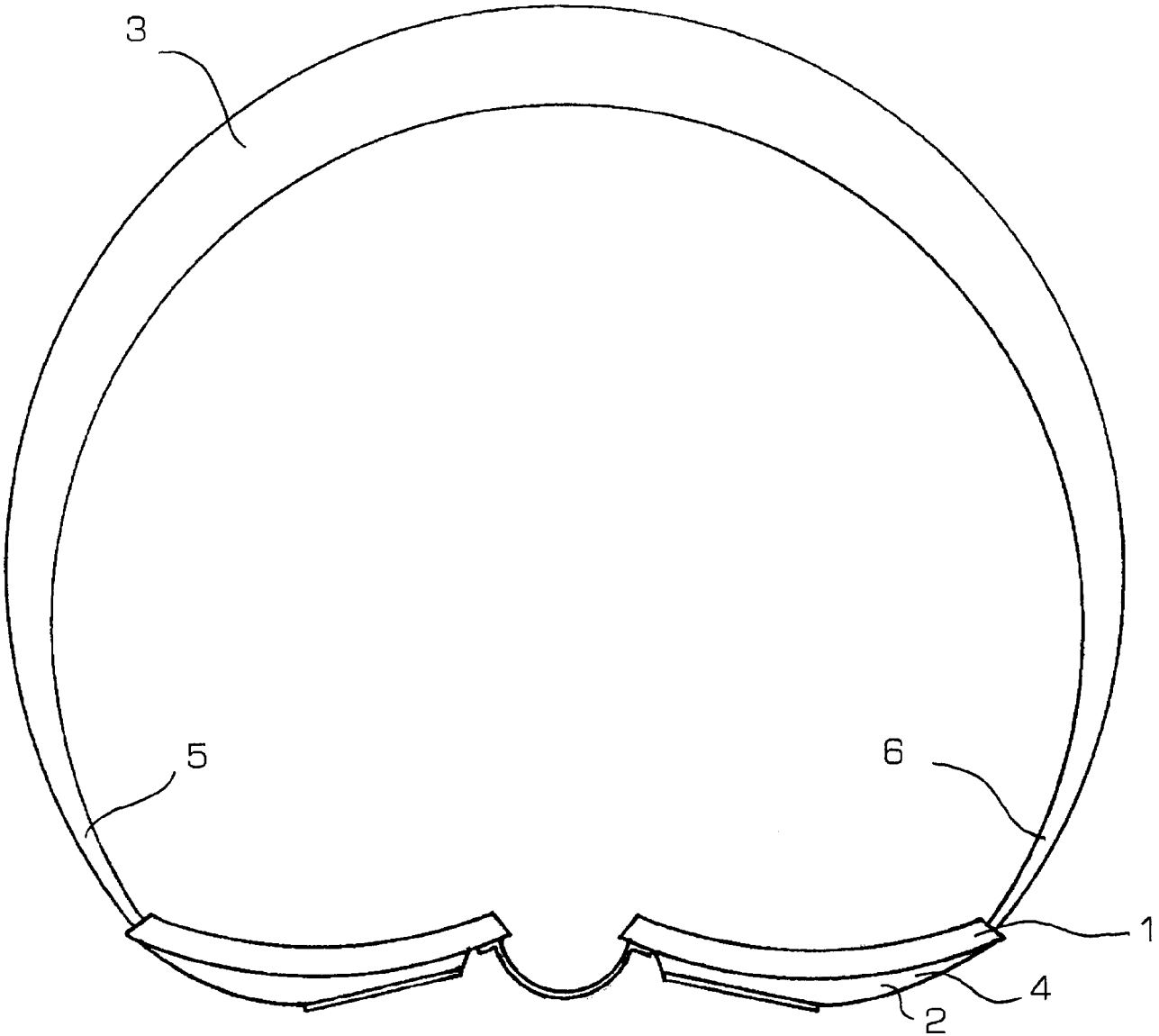
FIG. 1 is a top view of the goggles of the invention equipped with an auxiliary air source chamber.

FIG. 1 shows a top view of the goggles of the invention. Typical goggles can form one or two face chambers between the rigid portions of the goggles and the face of the diver. In case of a large single lens such as used in most diving masks, there will be only one face chamber. In case of two separate lens connected by a flexible nose strap as shown on FIG. 1, there will be two separate sealed face chambers formed between the hard lens portion of the goggles and the skin of the diver's face around the eyes. The main idea of the invention is equally applicable to both types of goggles design as will be apparent from the following description.

Frame 1 of the goggles is shown on FIG. 1 as containing two separate curved lenses 2. Each lens 2 is surrounded by a flexible skirt of the type known in the prior art for sealing against the eyes of the diver. It can be made from a flexible polymer elastomeric material, rubber, silicone, or another known appropriate material. Once positioned on the diver's face, the skirts form two face chambers 4 defined by the shape of the lens 2, the shape of the diver's face and the distance therebetween. The face chamber 4 traps within it a certain volume of air at atmospheric pressure.

Figure 6:
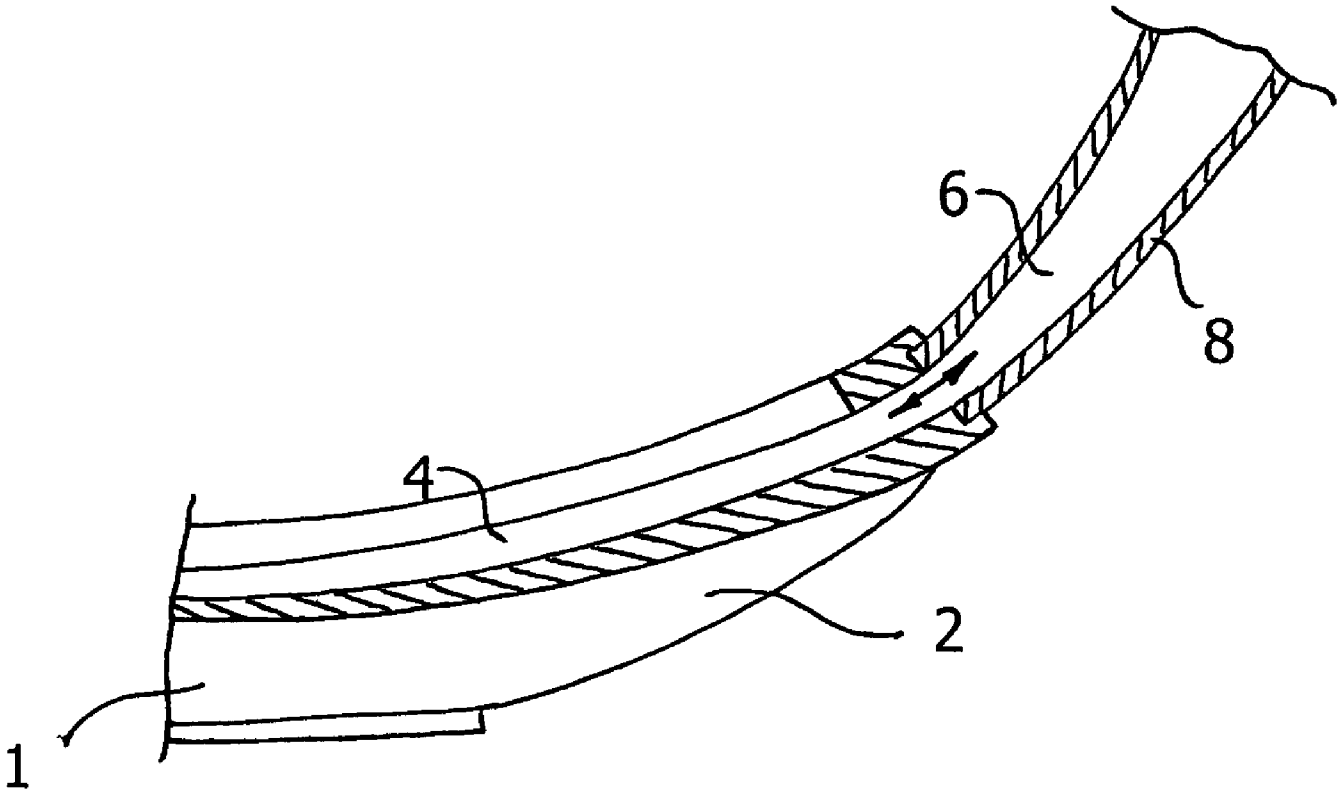

An auxiliary air source chamber 3 is mounted over or is incorporated with the goggles holding strap. The chamber 3 is attached to the frame 1 on both ends of the goggles so that its ends 5 and 6 are in constant fluid communication with the face chambers 4 thereof, as shown in detail on FIG. 6. The air source chamber 3 has a cavity inside defining its internal volume. Its has a generally oval shape repeating the shape of a typical human head. Its central portion is enlarged in the area to the side and back of the diver's head while its ends 5 and 6 are narrowed towards the frame portion 1 of the goggles of the present invention.

Figure 2:
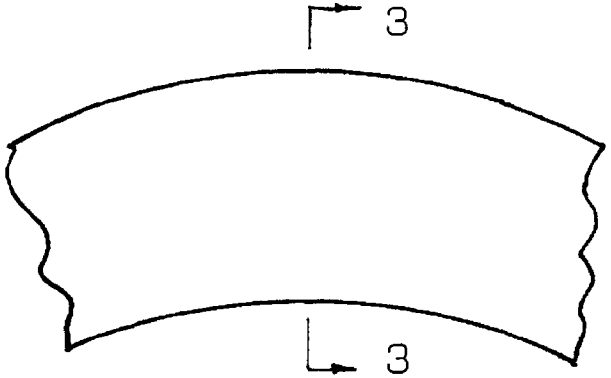
FIG. 2 is a top view of the portion of the auxiliary air source chamber of the invention.
Figure 3:
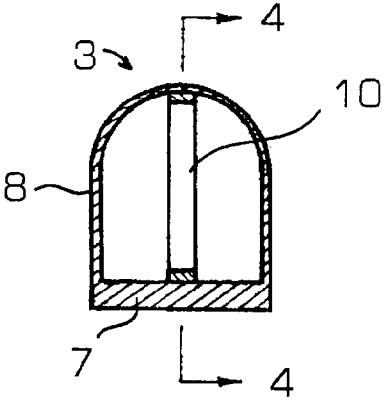
FIG. 3 is a cross-sectional view of the auxiliary chamber of the invention shown in FIG. 2.

FIG. 2 shows a general top view of the preferred configuration of the auxiliary chamber 3 in its wider center portion behind the head of the diver. In this configuration, the chamber is combined with a holding strap of the goggles. It is possible, however, to attach a separate chamber to an existing strap of the standard goggles in which case there will be two distinct parts surrounding the head of the diver. FIG. 3 shows a cross-section taken across the view shown on FIG. 2 as indicated on the drawing. The chamber 3 is designed to have a more heavy and thick strap portion 7 designed to serve as a non-extensible holding element for the goggles around the head of the diver. The rest of the chamber is a thinner collapsible portion 8 attached to the portion 7 on both ends. This portion of the chamber is designed to be easily collapsed or extended under outside pressure. The entire chamber may be molded or extruded as a single unit or alternately can be assembled by welding, gluing or other appropriate techniques.

Figure 4:
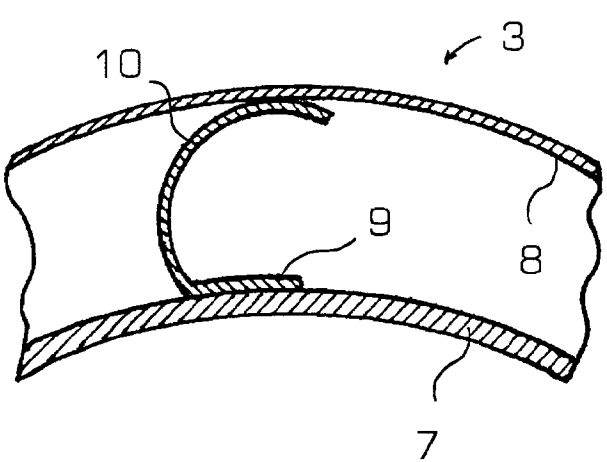
FIG. 4 is a cross-sectional view from FIG. 3 showing the auxiliary air source chamber in the initial uncompressed state before diving.
Figure 5:
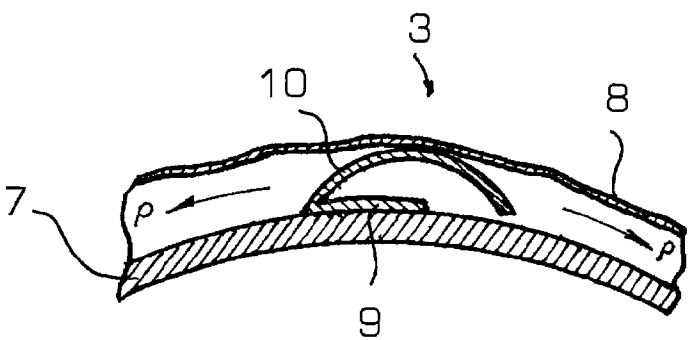
FIG. 5 is the same cross-sectional view of the auxiliary chamber as in FIG. 4 but now it is shown compressed by the surrounding water at a reasonable depth of diving.

In order to maintain the collapsible portion 8 in its expanded position, an elastic supporting means are provided within the auxiliary chamber 3. One possible configuration of such supporting means is a curved leaf spring 10 extending from its base 9 attached to the portion 7 of the chamber. Depending on the outside pressure, the leaf spring 10 can extend or collapse allowing the chamber to change its internal volume. FIG. 4 shows the spring 10 in its extended initial position supporting the chamber 3 while FIG. 5 shows the spring 10 and the chamber 3 in its collapsed position while under water pressure. As the chamber 3 collapses, air is running out towards both sides of the chamber 3 as shown by arrows P on FIG. 5. During the collapse of the air chamber 3, the thin portion 8 moves closer to the thick strap portion 7 of the chamber. Once the outside pressure is reduced, the spring 10 pushes the thin portion 8 back and away from the strap portion 7 of the chamber as its internal volume increases. The leaf spring 10 may be made of a polymer material or a metal. Optionally, several leaf springs 10 are positioned throughout the entire chamber 3 in order to restore its original shape once out of the water.

Another variation of the invention includes incorporating the elastic supporting means into the collapsible portion 8 itself. This can be realized by imbedding a spring element therein or alternatively, selecting the shape, thickness and the material or a combination thereof in such a way that the collapsible portion 8 has enough resiliency to spring back once the underwater pressure is removed. In its most simple and direct application, the thickness and the material are selected to achieve this goal. For example, if the collapsible portion 8 is made of rubber, its thickness can range from about 1/32 of an inch (about 0.8 mm) to about 1/8 of an inch (3.175 mm) to provide enough resiliency for proper operation.

In use, once the diver puts on the goggles of the invention, one or two face chambers are formed between the diver and the goggles in the area of the diver's eyes. The chamber 3 is fully extended in its initial shape since it was exposed to atmospheric pressure and the elastic supporting means were in their extended state. The chamber 3 is maintained in fluid communication with all sealed face chambers 4. As the diver descends into the water depths, the outside air pressure is gradually increasing. The pressure inside the face chambers 4 is also increasing as the water pushes the lenses 2 against the face of the diver. As opposed to the goggles of the prior art, where the increased pressure in the face chambers 4 caused negative effects on the eyes of the diver; according to the present invention the increasing outside water pressure causes the gradual collapse of the auxiliary air source chamber 3. The elastic supporting means such as spring 10 is compressed and the thin collapsible portion 8 moves closer to the thick strap portion 7. Compressed air leaves the internal cavity of chamber 3 and is forced into the face chambers 4 as shown by arrows P on FIG. 5. As a result, additional compressed air from the chamber 3 is added to the already compressed air in the chambers 4 to compensate for the outside pressure and relieve the pressure around the eyes of the diver. The volume of the auxiliary chamber 3 along with the volumes of the face chambers 4 and the shape of the diver's face determine together the maximum depth at which the compensation from the goggles of the invention is still effective. Beyond that depth, additional compression may result is some negative effect on the diver's eyes but still far less than with the use of standard goggles. Therefore, the goggles of the present invention provide for deeper dives than the standard goggles.

As the diver ascends to the surface, the outside pressure is decreasing and the reverse effect takes hold. Namely, air is leaving chambers 4 and moves back into the internal cavity of the chamber 3 as the leaf spring 10 extends the strap portion 7 away from the thin portion 8 of the goggles.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A diving goggles for use by a diver, said diving goggles creating at least one sealed face chamber between the interior of said goggles and at least eyes of the diver when worn by the diver, the goggles comprising:

at least one rigid frame containing a lens, said frame defining a part of said face chamber, and a collapsible auxiliary air source chamber in fluid communication only with the interior of said rigid frame, said auxiliary chamber extends from one side of said rigid frame around the head of the diver and towards another side of said rigid frame so as to retain said diving goggles about the diver's face, wherein when collapsed said auxiliary air source chamber displaces air into said face chamber while under water to relieve the pressure on the face of the diver.

2. The diving goggles as in claim 1, wherein said auxiliary chamber incorporates a strap portion to retain said goggles around the head of the diver.

3. The diving goggles as in claim 2, wherein said auxiliary chamber is comprises a thin collapsible portion forming the strap portion to define in combination a sealed internal collapsible cavity therebetween.

4. The diving goggles as in claim 3, wherein said auxiliary chamber further comprising an elastic supporting means for keeping said thin collapsible portion in extended stare when out of water.

5. The diving goggles as in claim 4, wherein said elastic supporting means comprising a leaf spring.

6. The diving goggles as in claim 4, wherein said elastic supporting means are incorporated within said thin collapsible portion.

7. The diving goggles as in claim 6, wherein said elastic supporting means are is defined by the thickness and material choice of said thin collapsible portion.

8. The diving goggles as in claim 7, wherein said thin collapsible portion is made of rubber with its thickness ranging from about 1/32 of an inch (0.8 mm) to about 1/8 of an inch (3.175 mm).

9. The diving goggles as in claim 1, wherein said auxiliary chamber defining a center portion and two end portions, said end portions attached to said rigid frame, said center portion being wider in cross-section then said two end portions.

* * * * *